US007113736B2

(12) United States Patent
Kikuchi et al.

(10) Patent No.: US 7,113,736 B2
(45) Date of Patent: Sep. 26, 2006

(54) IMAGE FORMING APPARATUS

(75) Inventors: Kazuhiko Kikuchi, Yokohama (JP); Kazushige Morihara, Yokohama (JP); Satoshi Kinouchi, Tokyo (JP); Osamu Takagi, Tokyo (JP); Shin Yamauchi, Yokohama (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 38 days.

(21) Appl. No.: 10/805,507

(22) Filed: Mar. 22, 2004

(65) Prior Publication Data

US 2005/0207804 A1 Sep. 22, 2005

(51) Int. Cl.
*G03G 15/20* (2006.01)

(52) U.S. Cl. ..... 399/328; 219/619; 219/39; 399/336

(58) Field of Classification Search ..... 219/216, 219/672, 619; 399/328, 330, 334, 107, 122, 399/336

See application file for complete search history.

(56) References Cited

U.S. PATENT DOCUMENTS

| | | | | |
|---|---|---|---|---|
| 6,026,273 | A | 2/2000 | Kinouchi et al. | |
| 6,252,212 | B1 * | 6/2001 | Takagi et al. | 219/619 |
| 6,321,046 | B1 | 11/2001 | Kikuchi et al. | |
| 6,377,778 | B1 | 4/2002 | Kikuchi et al. | |
| 6,522,846 | B1 | 2/2003 | Kinouchi et al. | |
| 6,721,530 | B1 * | 4/2004 | Hirst et al. | 399/328 |

FOREIGN PATENT DOCUMENTS

| | | | |
|---|---|---|---|
| JP | 9-16006 | A | 1/1997 |
| JP | 11-297462 | A | 10/1999 |
| JP | 2001-313162 | A | 11/2001 |

* cited by examiner

*Primary Examiner*—Hoang Ngo
(74) *Attorney, Agent, or Firm*—Foley & Lardner LLP

(57) ABSTRACT

A distance defined by expression 2 is secured between the exciting coil and the protection cover. This not only prevents a magnetic field with a specific magnetic field intensity or higher from leaking to the outside but also reduces the effect on the circuits in the apparatus or optionally installed circuits (including a printer controller and a FAX controller).

6 Claims, 5 Drawing Sheets

IMAGE FORMING APPARATUS

BACKGROUND OF THE INVENTION

1. Field of the Invention

This invention relates to a fixing apparatus which fixes a developer image on paper and an image forming apparatus provided with the fixing apparatus, such as a copying machine or a printer.

2. Description of the Related Art

In the field of fixing apparatus installed in copying machines using electrophotographic processes, a fixing apparatus which includes an induction heating unit that generates hear by use of an electromagnetic induction has recently been put to practical use. In many cases, a heating (fixing) roller in which a heater is set and a pressure roller pressed against the heating roller at a specific pressure at one point of the outer circumference of the heating roller are used. It is well known that such a configuration enables not only the heat of the heating roller to be supplied to toner efficiently but also pressure for fixing the melted toner to a transfer medium to be applied to the transfer medium and toner efficiently.

One known fixing apparatus using induction heating is such that, for example, the magnetic flux leaking from the induction coil provided outside the fixing roller is suppressed by a shield member, which enhances the heat dissipation of the induction coil (Jpn. Pat. Appln. KOKAI Publication No. 2001-313162).

Another known induction heating fixing apparatus with exciting coil outside the rotating body is such that the arrangement of a magnetic material on the opposite side of the rotating body of the exciting coil not only increases the heat generation efficiency but also prevents the magnetic field produced from the exciting coil from leaking to the adjoining parts (Jpn. Pat. Appln. KOKAI Publication No. 11-297462).

A further known induction heating fixing apparatus is such that an induction heating member, a film member for moving the heating member, and an exciting coil fixing member have a ferromagnetic, high-sensitivity shield member, thereby preventing electromagnetic noise leaks (Jpn. Pat. Appln. KOKAI Publication No. 9-16006).

In an image forming apparatus with a heating unit using such induction heating, the high-frequency magnetic field generated from the coil can reach the circuit board in the apparatus or the printer controller or FAX controller optionally installed, which results in the problem of causing the devices or units to malfunction.

In addition, when a thin-film conductive member is used for induction heating to increase the efficiency in producing rapid temperature changes, or when the temperature is raised from room temperature to the requested fixing temperature (in warm-up), the high-frequency magnetic field generated from the coil can have a greater effect on the units in the apparatus.

Furthermore, even when a shield member is used, the high-frequency magnetic field from the coil can leak from the spacing or the like to secure a space through which the transfer medium is to be transported.

BRIEF SUMMARY OF THE INVENTION

According to an aspect of the present invention, there is provided a fixing apparatus comprising: a coil which, when supplied with a voltage and current of a specific frequency, forms a first area having a magnetic field intensity equal to or higher than a specific intensity on the outside of the coil and a second area having a magnetic field intensity lower than the specific intensity on the outside of the coil; a conductive member which generates heat by a magnetic field supplied from the coil; and an protection cover covering the periphery of the fixing apparatus which is provided near the boundary line between the first area and the second area so that its surface may have the specific magnetic field intensity or less.

According to another aspect of the present invention, there is provided an image forming apparatus comprising: a fixing apparatus including a coil which, when supplied with a voltage and current of a specific frequency, forms a first area having a magnetic field intensity equal to or higher than a specific intensity on the outside of the coil and a second area having a magnetic field intensity lower than the specific intensity on the outside of the coil, and a conductive member which generates heat by a magnetic field supplied from the coil; and an protection cover housing the fixing apparatus which is provided in a position where the first area is formed inside so that its surface may have the specific magnetic field intensity or less.

According to a further another aspect of the present invention, there is provided an image forming apparatus comprising: a fixing apparatus including a coil which, when supplied with a voltage and current of a specific frequency, generates a magnetic field with a specific magnetic field intensity, and a conductive member which generates heat by a magnetic field supplied from the coil; and an protection cover covering the periphery of the fixing apparatus which is at a specific distance away from the surface of the coil.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Hereinafter, referring to the accompanying drawings, an example of an image forming apparatus to which an embodiment of the present invention is applied will be explained.

Figure 1:
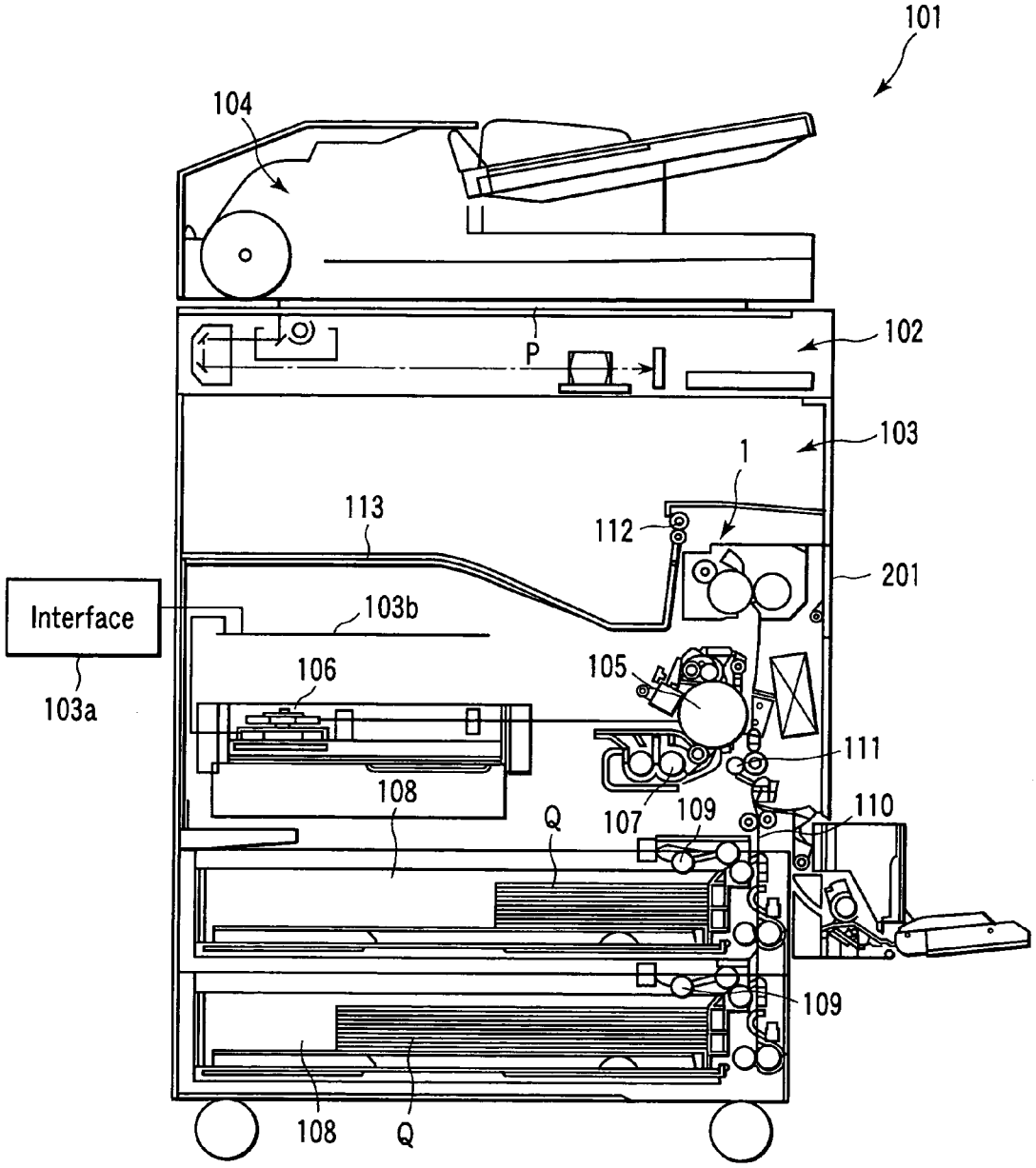
FIG. 1 is a schematic diagram to help explain an example of an image forming apparatus into which a fixing apparatus of the present invention is incorporated.

As shown in FIG. 1, an image forming apparatus (digital copying machine) 101 comprises an image reading unit (scanner) 102 for generating an image signal by reading an object (document) P to be read or copied, an image forming section 103 for forming an image on the basis of the image signal outputted from the scanner 102, and an protection cover 201 provided on the outermost part of the image forming apparatus or between the units or circuits explained below. An image signal outputted from a printer board 103*b* to which an interface 103*a* is connected may be inputted to the image forming section 103. An automatic document feeding unit (ADF) 104 may be provided integrally in the scanner 102.

The image forming section 103 includes a fixing apparatus 1, a photoreceptor drum 105, a photolithography machine 106, a developing machine 107, a sheet cassette 18, a pickup roller 109, a transport path 110, an aligning roller 111, a discharge roller 112, and a catch tray 113.

The fixing apparatus 1 applies heat and pressure to a sheet Q which holds a toner image, thereby setting (fixing) the melted toner image to the sheet Q.

Figure 2:
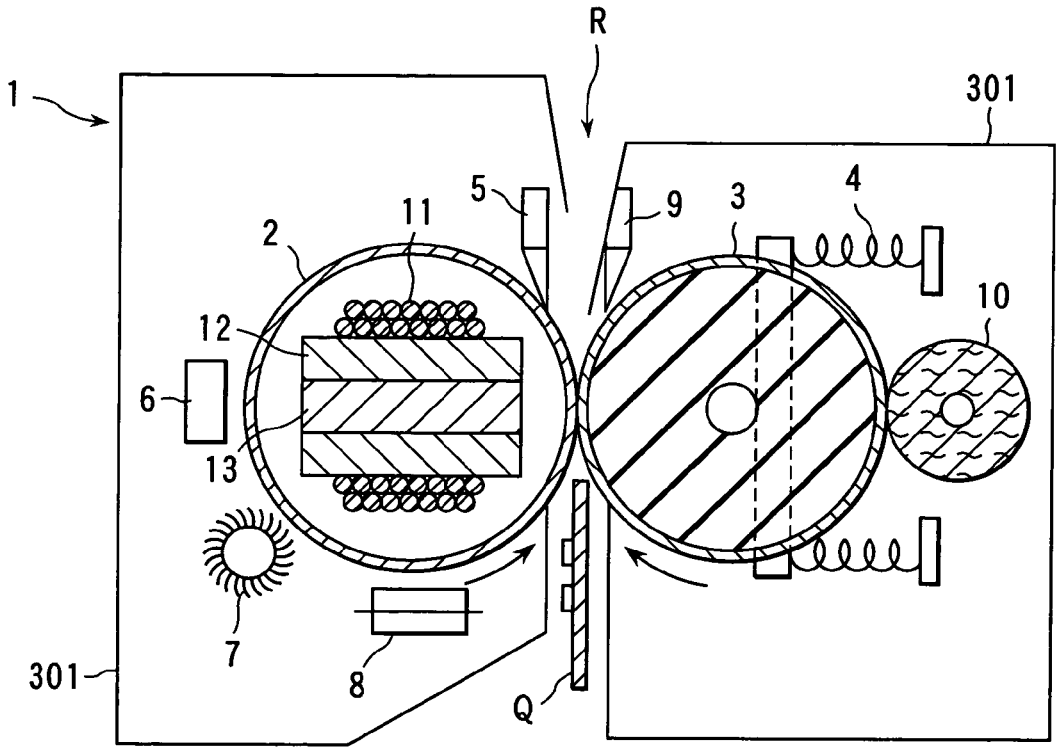
FIG. 2 is a schematic diagram to help explain an example of a fixing apparatus usable in the image forming apparatus of FIG. 1.
Figure 3:
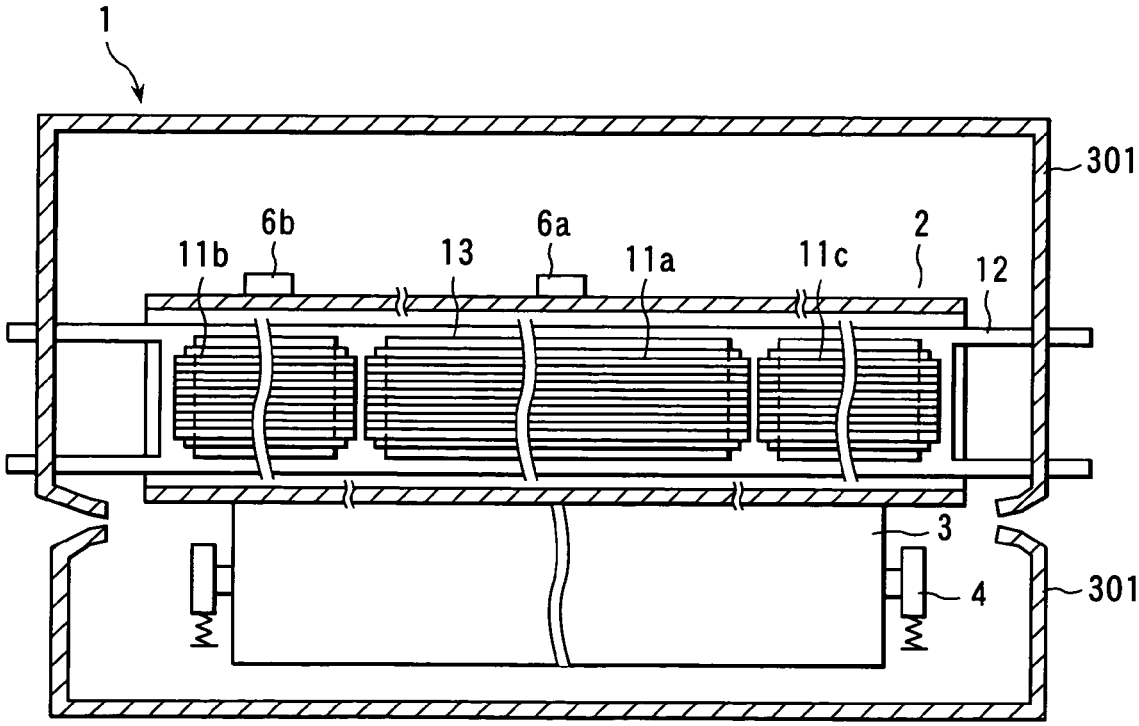
FIG. 3 is a schematic diagram to help explain an example of the arrangement of exciting coils in the fixing apparatus of FIG. 2.

FIGS. 2 and 3 are schematic diagrams to help explain an example of the fixing apparatus used in the image forming apparatus of FIG. 1.

FIG. 2 is a schematic plan view to help explain an example of the fixing apparatus 1.

The fixing apparatus 1 includes a fixing (heating) roller 2, a press (pressure) roller 3, a pressure mechanism 4, a peeling claw 5, a temperature sensing element 6, a cleaning member 7, a heat generation abnormality sensing element 8, a peeling claw 9, a cleaning roller 10, an exciting coil 11, a coil holder 12, a magnetic core 13, a fixing protection cover 301.

The heating roller 2 is such that a metal hollow cylinder conductive member with a thickness of about 1 mm, preferably about 0.5 mm is held in roller form. While in the embodiment, the conductive member of the heating roller 12 is made of iron, it may be made of stainless steel, nickel, aluminum, an alloy of stainless steel and aluminum, or the like. In the embodiment, a conductive member made of a iron (e.g., STKM material) tube of 0.4 to 1.5 mm thick is used for the heating roller 2 and the magnetic field from the exciting coil 11 is caused to pass through the heating roller 2, thereby decreasing the magnetic field to a specific magnetic field intensity. On the surface of the heating roller 2, a separate layer (not shown) is formed by depositing fluorocarbon resin, such as tetrafluoroethylene resin, to a specific thickness. In the embodiment, each of the fixing roller 3 and heating roller 2 has an outside diameter of 40 mm.

The pressure roller 3 is an elastic roller which is such that a rotation axis with a specific diameter is covered with silicone rubber, fluoric rubber, or the like of a specific thickness.

The pressure mechanism 4 is pressed against the axis line of the heating roller 2 at a specific pressure. The pressure roller 3 is kept almost in parallel with the axis line of the heating roller 2.

As a result, a part of the outer circumferential surface of the heating roller 3 is deformed elastically, with the result that a specific nip is formed between the two rollers.

The heating roller 2 is rotated substantially a constant speed in the direction shown by the arrow by a fuser motor 123 explained later with reference to FIG. 4 or a drum motor 121 for rotating the photoreceptor drum 105. Since the pressure roller 3 is brought into contact with the heating roller 2 at a specific pressure by the pressure mechanism 4, when the heating roller 2 is rotated, the pressure roller 3 is rotated in the position where it touches the pressure roller 3, in the opposite direction to the direction in which the heating roller 2 is rotated.

The peeling claw 5 is provided on the circumference of the heating roller 2 on the downstream side in the direction in which the roller 2 is rotated by the nip where the heating roller 2 and the pressure roller 3 are in contact with each other and in a specific position near the nip. The peeling claw 2 peels the sheet Q passing through the nip from the heating roller 2.

The temperature sensing element 6, which is composed of, for example, a thermistor, senses the temperature of the outer circumferential surface of the heating roller 2. The temperature sensing element 6 includes a temperature sensing element 6*a* provided almost in the middle in the longitudinal direction of the roller, and a temperature sensing element 6*b* provided at one end in the longitudinal direction of the roller. Two or more, for example, three temperature sensing elements 6 may be used.

The cleaning member 7 removes toner occasionally adhering to the fluorocarbon resin formed to a specific thickness on the outer surface of the heating roller 2, and paper powder produced from sheets, and dust or the like floating in the apparatus and adhering to the heating roller 2. The cleaning member 7 includes a cleaning member made of a material less liable to damage the fluorocarbon resin layer, such as a felt or fur brush, although it is in contact with the heating roller 2, and a support member for supporting the cleaning member 7. The cleaning member 7 may be rotated in contact with the surface of the heating roller 2 or be pressed against the outer circumferential surface of the heating roller 2 at a specific pressure (without rotation).

The heat generation abnormality sensing element 8, which is, for example, a thermostat, senses the heat generation abnormality of the surface temperature of the heating roller 2 rising abnormally. When a heat generation abnormality has occurred, the heat generation abnormality sensing element 8 is used to cut off the electric power supplied to the heating coil (exciting coil) explained below.

The order in which the temperature sensing elements 6*a*, 6*b*, cleaning member 7, and heat generation abnormality sensing element 8 are arranged and their locations are not limited to the order and locations shown in FIG. 2.

The peeling claw 9 for peeling the sheet Q from the pressure roller 3 and the cleaning roller 10 for removing toner adhered to the surface of the pressure roller 3 are provided on the circumference of the pressure roller 3.

The heating roller 2 includes the exciting coil 11 for supply a specific magnetic field to the heating roller 2 composed of a conductive member, a coil holder 12 for holding the exciting coil 11, and the magnetic core 13 for increasing the flux density of the magnetic field generated from the exciting coil 11 usable to cause the heating roller 2 to generate heat.

The coil holder 12 has high heat resistance and high insulation. For example, the coil holder is made of engineering plastic, ceramic, PEEK (polyether ether ketone) material, phenol material, unsaturated polyester, or the like.

The magnetic core 13 is made mainly of a material with low losses at high frequencies, such as a dust core. The excitation coil 11 may be an air-core coil without a magnetic core material.

The fixing protection cover 301, which is the outermost part of the fixing apparatus 1, holds the individual members included in the fixing apparatus in place.

FIG. 3 is a schematic diagram of the fixing apparatus 1 of FIG. 2 viewed from the direction shown by the arrow R, with a part of the cover broken away.

The exciting coil 11 is composed of a first coil 11*a* located almost in the middle in the longitudinal direction of the heating roller 2, and a second coil 11*b* and a third coil 11*c* located near at both ends in the longitudinal direction of the heating roller 2, that is, at both ends of the first coil 11*a*.

The first coil 11*a* (center coil) is so formed that it has such a length as, when, for example, a A4-size sheet is conveyed in such a manner that its short side is in parallel with the axis line of the heating roller 2, enables the width of the sheet contacting the outer circumferential surface of the roller 2 to be heated.

The second and third coils 11*b*, 11*c* (end coils) are a single coil electrically and connected in series. When they are arranged in line with the first coil 11a as shown in FIG. 3, the longitudinal length is equal to the short side of an A3-size sheet.

The first, second, and third coils 11*a*, 11*b*, and 11*c* are made of a wire material whose cross-sectional area is equivalent to, for example, a 1-mm copper material. A stranded wire formed by stranding a plurality of thin wire materials with no insulating film, a litz wire formed by stranding a specific number of wire materials each covered with insulating material, or the like may be used as the wire material. Each of the coils 11*a*, 11*b*, and 11*c* can be formed by an arbitrary winding method. They are wound around the coil holder 12.

A voltage and current of a specific resonance frequency are supplied to each coil. The coil then applies a magnetic field of a specific magnetic field intensity to a specific part of the heating roller 2, thereby generating a magnetic flux and an eddy current in the heating roller 2. The eddy current and heating roller resistance produce Joule heat, thereby heating the heating roller 2.

Therefore, the second and third coils 11*b*, 11*c* are helpful in heating the vicinities of both ends of the heating roller 2, whereas the first coil 11*a* can heat the middle in the longitudinal direction of the heating roller 2.

The center coil and end coils may be divided, for example, almost in the middle of the heating roller 2 into two. Alternatively, for example, when a coil is provided for the pressure roller 3, the first coil 11*a* (center coil) may be provided on the heating roller 2 side and the second coil 11*b* (end coil) may be provided on the pressure roller 3 side.

A wire material with a specific cross-sectional area is used for the first, second, and third coils 11*a*, 11*b*, and 11*c*. Each of the first, second and third coils has a specific number of turns so as to resonate at its inherent resonance frequency, thereby maximizing its resistance value. They are designed to produce almost the same outputs. The total current output of the coils is sufficient to produce a magnetic flux capable of producing an eddy current to cause the heating roller 2 (or pressure roller 3) to generate heat. This output is controlled by controlling the power consumed by the coils.

Figure 4:
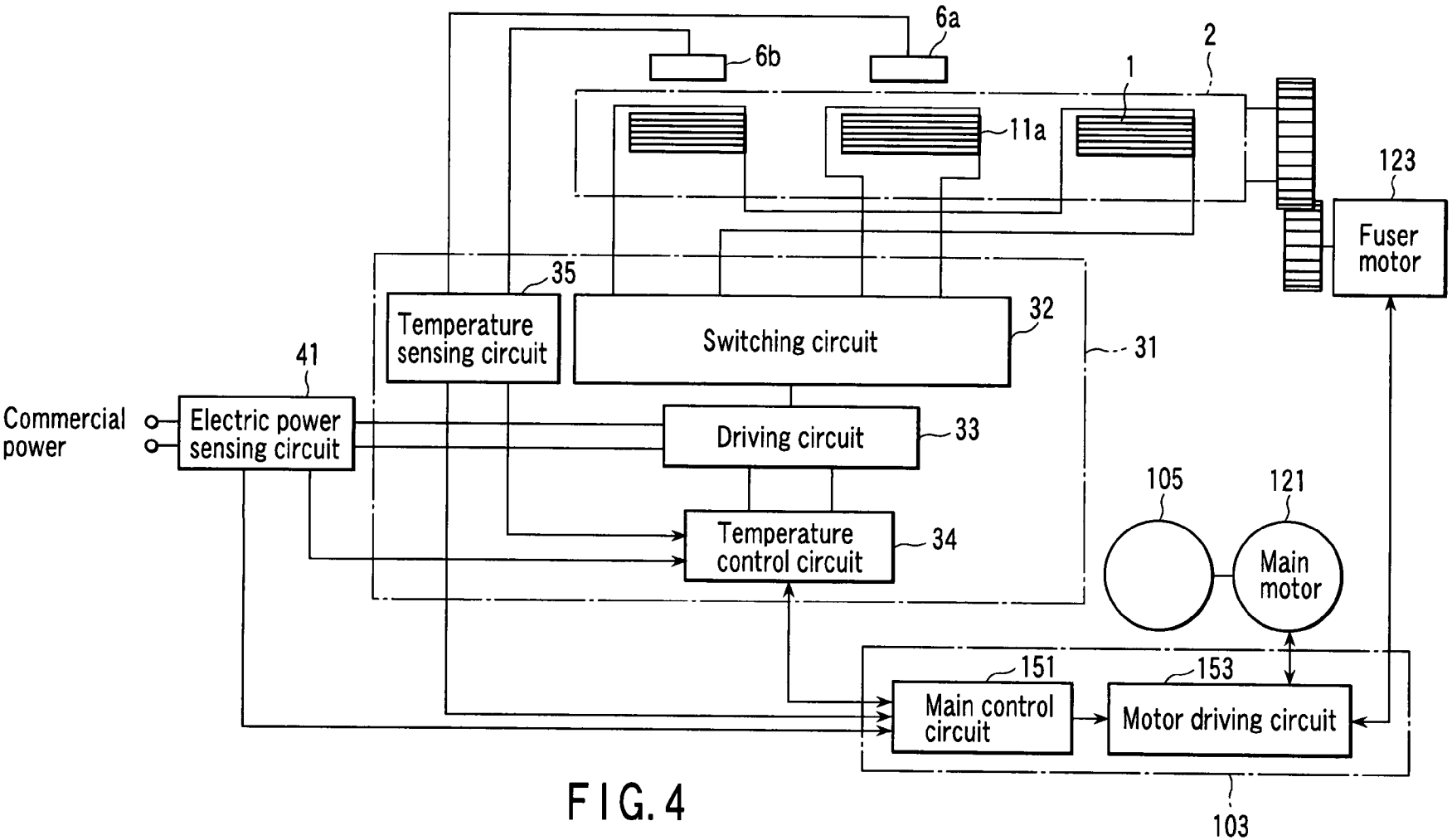
FIG. 4 is a schematic diagram to help explain the fixing apparatus shown in FIGS. 2 and 3 and the control system of the image forming apparatus of FIG. 1.

FIG. 4 is a diagram to help explain a driving circuit for operating the fixing apparatus 1 shown in FIGS. 2 and 3 and a control circuit for operating the image forming apparatus into which the fixing apparatus 1 is incorporated.

The heating roller 2 of the fixing apparatus 1 houses the exciting coil 1 (coils 11*a*, 11*b*, 11*c*) for producing eddy current in the conductive material of the heating roller 2 as described above and thereby generating heat.

Connected to the exciting coil 11 is an exciting unit 31 for supplying high-frequency outputs of a specific frequency (current and voltage) to each coil of the exciting coil 11.

The exciting unit 31 includes a switching circuit 32 capable of outputting high-frequency outputs to be supplied to the individual coils 11*a*, 11*b*, 11*c* and a driving circuit 33 for inputting a specific control signal (the number of times of switching) to the switching circuit 32 to supply a specific output to the respective coils.

The switching circuit 32 is capable of, for example, connecting all of the coils 11*a*, 11*b*, 11*c* in series, or connecting the coils 11*b*, 11*c* in series and then connecting the resulting series connection in parallel with the coil 11*a*, or connecting all of the coils 11*a*, 11*b*, 11*c* in parallel. That is, the switching circuit 32 also functions as a selector unit capable of setting a series connection or a parallel connection between the individual coils 11*a*, 11*b*, 11*c*.

A direct-current voltage obtained by rectifying a received commercial power alternating voltage with a rectifier (not shown) is supplied via the driving circuit 33 to the switching circuit 32.

At this time, the driving circuit 33 informs the switching circuit 32 the high-frequency outputs to be outputted by the switching circuit 32, or the time that the switching elements (not shown) are turned on for the respective coils 11*a*, 11*b*, 11*c* to output the coil outputs, specific heating power, or the number of times the switching element is turned on during a unit time (driving frequency).

In the embodiment, the driving circuit 33 informs the switching circuit 32 to supply a first frequency f1 to the coil 11*a* and a second frequency f2 to the coil 11*b*. In other words, the magnitude of the magnetic flux, or the heating power, outputted from each coil to produce an eddy current in the heating roller 2 to raise the temperature of the heating roller 2 can be set to an arbitrary magnitude by controlling the driving circuit 33 to change the outputs from the switching circuit 32 to the respective coils.

The heating power is generally managed in values in the form of the amount of power consumed by each coil. Hereinafter explanation will be given, regarding the coil output (power consumption) of each coil just as an electric power inputted to a coil and the frequency of the power consumption as the frequency used.

The electric power supplied from the rectifying circuit to an arbitrary one or all of the coils is always monitored by an electric power sensing circuit 41 provided in a specific place, such as between the rectifying circuit and the input terminal of a commercial power supply, between the rectifying circuit and the driving circuit 33, or between the driving circuit 33 and the switching circuit 32.

The result of the monitoring by the electric power sensing circuit 41 is fed back to the driving circuit 33 with a specific timing. To make it possible to sense the burnout or the like of the driving circuit 33, the output of the electric power sensing circuit 41 is also inputted to a main control unit 151 on the image forming section 103 side.

The main control unit 151 is connected to a motor driving circuit 153.

The motor driving circuit 153 is connected to a main motor 121 for supplying driving force to a specific member of the image forming section 103, such as the photoreceptor drum 105, and the fuser motor 123 for rotating the heating roller 2.

Next, an example of control to raise the temperature at the outer circumferential surface of the heating roller 2 to a specific temperature will be explained.

As is commonly known, in the fixing apparatus 1 of the induction heating type, each of the coils 11*a*, 11*b*, 11*c* of the exciting coil 11 produces a magnetic flux in a specific direction, depending on the amount of power supplied to the coil and the form of the coil. Therefore, eddy current develops in the metal part of the heating roller 2 so as to prevent the change of the magnetic field produced by the magnetic flux generated in the coil. As a result, Joule heat is caused in the metal part of the heating roller 2 by the eddy current and the resistance of the metal part.

The heating roller 2 generates heat due to the Joule heat, thereby raising the temperature of the heating roller 2, with the result that the sheet Q passing through between the heating roller 2 and the pressure roller 3 is heated. In normal heating whereby the whole area in the longitudinal direction of the heating roller 2 is heated almost uniformly, the switching circuit 32 explained in FIG. 4 supplies high-frequency outputs (current and voltage) to each of the coils 11*a*, 11*b*, 11*c*.

In a case where electric power of a specific frequency is supplied to a first coil and a second coil differing in a coil constant, such as inductance L (the inductance of the second coil is lower than that of the first coil), when an independent switching circuit is provided, an attempt to control the output of the second coil in the same range as that of the first coil requires the second coil to have the frequency range of about 30 kHz to 40 kHz, provided that, for example, the frequency range required to control the output of the first coil in the range of 1 kW to 600 W is from 20 kHZ to 30 kHz.

That is, when the coil outputs of the coils differing in inductance are changed, operating the individual coils independently results in a small variation in the frequency.

In contrast, in a case where the first coil with a specific inductance and the second coil with a lower inductance than that of the first coil are connected to a single switching circuit and electric power of a specific frequency is supplied, for example, when the output of the first coil is 900 W and the output of the second coil is 1.1 kW at a frequency of 20 kHz, the output of the first oil is changed to 500 W and the output of the second coil is changed to about 0.9 kW at a frequency of 30 kHz. In addition, when the frequency is changed to 40 kHz, the output of the first coil is lowered to about 200 W, whereas the output of the second coil is kept at about 500 W.

Next, the relationship between the frequency of electric power supplied to each coil and the coil output will be explained.

For example, electric power supplied to each of the coils 11*a*, 11*b*, 11*c* can be changed in the range of, for example, 700 W to 1.5 kW arbitrarily in terms of the amount of power consumed by the coil. As is generally known, the amount of current flowing in any one of the coils 11*a*, 11*b*, 11*c* of the exciting coil 11 is determined by setting a frequency applied to the coil, an impedance, and so forth.

For example, in a case where electric power differing only in frequency is supplied, even when the current value is 10 mA, the inductance and pure resistance are changed as follows: inductance L=24.6 μH, pure resistance R=1,2 Ω at 25 kHz, inductance L=18.69 μH, pure resistance R=3.5 Ω at 100 kHz, and inductance L=15.1 μH, pure resistance R=4,9 Ω at 1 MHz. Therefore, the higher the frequency, the larger the impedance.

As described above, the exciting coil 11 used for induction heating generates a magnetic field of a different intensity according to the frequency of the electric power supplied (frequency used). Therefore, in an operation mode requiring a high magnetic field intensity, even when the exciting coil 11 is housed in the heating roller 2 and therefore the heating roller 2 decreases the magnetic field intensity, there is a possibility that the magnetic field might leak to the outside. In addition, in a compact image forming apparatus, or in an image forming apparatus which has the catch tray 113 of FIG. 1 of FIG. 1 between the cassette 108 and the scanner 102, the fixing apparatus 1 is provided very close to the outside of the apparatus, there is a possibility that the magnetic field from the exciting coil 11 might leak to the outside, from a structural viewpoint.

If the magnetic field from the exciting coil 11 leaks to the outside, problems arise. They include malfunctions of the circuits or an optionally installed printer controller, FAX controller, or the like provided near the fixing apparatus 1, and an adverse effect of electromagnetic waves on users or servicepersons.

FIRST EMBODIMENT

Figure 5:
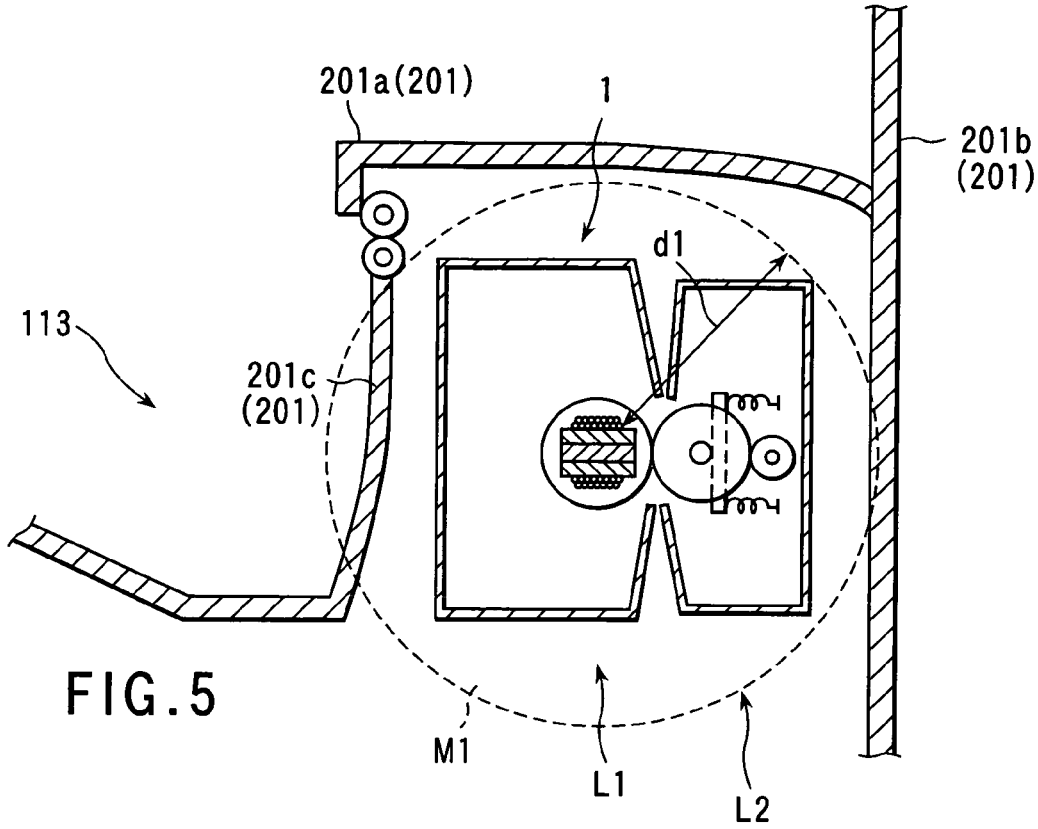
FIG. 5 is a schematic diagram to help explain the location of the exciting coil and the protection cover in the fixing apparatus usable in the image forming apparatus of FIG. 1.

FIG. 5 is a view of adjoining parts of a fixing apparatus provided in the image forming apparatus of FIG. 1, showing the positional relationship between the outside wall (protection cover) of the image forming apparatus 101 and the fixing apparatus.

As shown in FIG. 5, in the image forming apparatus 101 which has a catch tray 113 as shown in FIG. 1 between the cassette 108 and the scanner 102, the fixing apparatus 1 is provided close to the outside. Specifically, the fixing apparatus 1 is enclosed by an protection cover 201*a* close to the unit 1 on the upper side, an protection cover 201*b* close to the unit 1 on the right side, and an protection cover 201*c* close to the unit 1 on the left side. The protection covers 201*a*, 201*b*, 201*c* are included in the protection cover 201 of the image forming apparatus 101. Although they are divided and indicated by reference numerals for the sake of explanation, they may be formed integrally out of the same material.

Although not shown, a specific circuit or an optionally installed circuit or the like may be provided above the protection cover 201*a*. The protection cover 201*b* is the outermost part of the image forming apparatus shown in FIG. 1.

Therefore, the magnetic field from the exciting coil 11 leaking to the outside of the protection covers 201*a*, 201*b* is required to have such a strength as has no effect on the nearby circuits, optionally installed units, including a printer controller and a FAX controller, the user or serviceperson, and so forth.

In the image forming apparatus 101 of FIG. 1, since the catch tray 113 is formed on the right side of the protection cover 201*c*, the effect of the magnetic field need not be taken into account.

The fixing apparatus 1 is provided in a position that secures at least a distance of d1 between the surface of the exciting coil 11 and the protection covers 201*a*, 201*b* so that the magnetic field intensity at the surface of the protection covers 201*a*, 201*b* may be at a specific value or less. The position that secures the distance d1 presents a magnetic field intensity of t1 at which the effect on the nearby circuits and the like is alleviated.

The distance d1 is defined as a point on a rough circle M1, the boundary line between a first area L1 with a magnetic field intensity equal to or higher than the specific magnetic field intensity t1 and a second area L2 with a magnetic field intensity lower than the specific magnetic field intensity t1, when a voltage and current of a specific frequency of F are supplied. It is desirable that the specific frequency F should have the frequency (e.g. 20 kHz) of the electric power supplied to the exciting coil to generate a magnetic field of the highest magnetic field intensity. When the fixing apparatus is being used, the magnetic field intensity at the surface of the protection cover can be made t1 or lower.

As known from "Radio Wave Protection Standard" or the like, when a frequency of f (kHz) in the range of $0.8<f<150$ is used, if a magnetic field with a magnetic field intensity of 6.25 μT or more is applied to a circuit or the like, a problem might arise: for example, the circuit will possibly malfunction. Therefore, a circuit is provided around the unit generating a magnetic field, the magnetic field intensity applied to the circuit is required to be lower than 6.25 μT.

Therefore, each of the surfaces of the protection covers 201*a*, 201*b* has to be provided in a position where the magnetic field intensity is lower than 6.25 μT. Thus, it is desirable that the magnetic field intensity t1 should be equal to or lower than 6.25 μT.

In the first embodiment, the intensity of the magnetic field leaking from the exciting coil 11 to the adjacent areas is measured using a Combinover MPR-II (the frequency range of 2 k to 400 kHz). From the result of the measurement, the distance d1 is defined. Since the exciting coil 11 might generate harmonic magnetic fields according to the frequency of the voltage and current applied (the frequency used), it is desirable that the frequency range of the measuring instrument should be at least five times or more as high as the frequency used.

As known from "Method of checking conformance to the Radio Wave Protection Standard (ARIBRT-11)," it is determined that the range where the effect on the human body having the measuring instrument or the nearby metals or the like is alleviated in measuring the magnetic field shall be such that the distance from the measuring instrument is 20 cm or more away from every object in the case of a radiation source of a frequency of 300 MHz or more.

If the distance from the measuring instrument to one of the protection covers 201*a*, 201*b* is D1 and the magnetic field intensity measured by the instrument at the position is T1, since the magnetic field intensity is inversely proportional to the square of the distance, the distance d1 from the surface of the exciting coil 11 to the protection covers 201*a*, 201*b* meets the following equation:

$$t1 = \frac{T1(D1 + d1)^2}{d1^2} \quad \text{(Equation 1)}$$

Thus, the distance d1 has the range defined by the following expression:

$$d1 > \frac{\sqrt{A}\left(1 + \sqrt{A}\right)}{(1 - A)} \text{ where } A = \frac{T1}{6250}\ D1 \geqq 20 \quad \text{(Equation 2)}$$

As a result of the measurement under the above conditions, when the generated magnetic field intensity was the highest, for example, when the power consumption of the coil at the time of warm-up was the largest (e.g. 1300 W), the frequency was 20 kHz and the magnetic field intensity at a point 30 cm away from the protection cover was 350 nT.

Substituting the result into equation 2 gives the following:

$$\sqrt{6250} = \frac{\sqrt{350}\,(30 + d1)}{d1} \quad \text{(Equation 3)}$$

Then, it follows that d1=9.30.

Therefore, it is desirable that the exciting coil 11 should be provided at least 10 cm or more away from the protection covers 201*a*, 201*b*.

As a result, the magnetic field intensity applied to the circuits or optional units or the like provided near the fixing apparatus 1 is alleviated, which reduces malfunctions of the nearby devices.

It goes without saying that a similar effect can be expected by placing no object liable to be affected by the magnetic field in the first area L1 defined by the distance d1 in a position other than the protection covers 201*a*, 201*b*, for example, in the areas at both ends of the heating roller 2 in the axis direction, or in the lower area of the fixing apparatus 1.

SECOND EMBODIMENT

Figure 6:
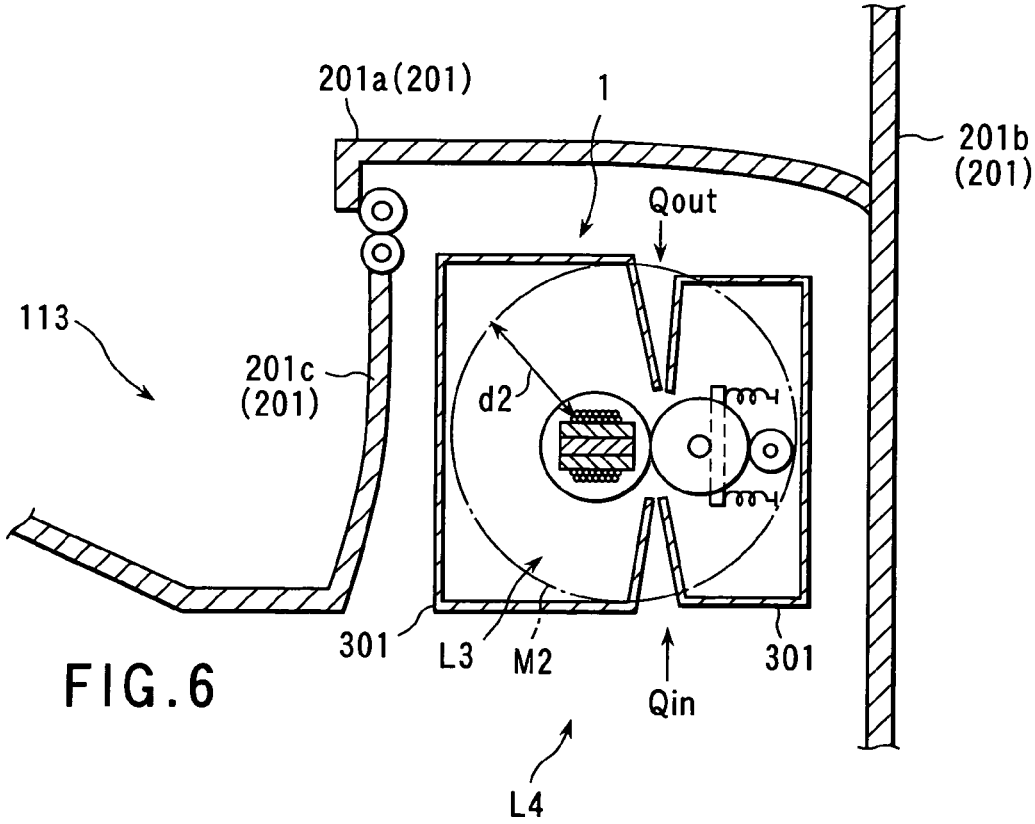
FIG. 6 is a schematic diagram to help explain another example of the location of the exciting coil and protection cover shown in FIG. 5.

The image forming apparatus shown in FIG. 1 enables a magnetic field intensity of 6.25 μT or less to be obtained at the surface of a fixing protection cover 301 provided inside the protection covers 201*a*, 201*b*, 201*c* and in the outmost part of the fixing apparatus 1 as shown in FIG. 6.

As shown in FIG. 6, the fixing protection cover 301 is provided a distance of d2 or more away from the surface of the exciting coil 11 excluding the inlet Qin and outlet Qout for the sheet Q. Like the distance d1, the distance d2 is defined as a position at which the effect on the nearby circuits and the like of the magnetic field intensity of t1 is alleviated. Specifically, the distance d2 is defined as a point on a rough circle M2, the boundary line between a first area L3 with a magnetic field intensity equal to or higher than the specific magnetic field intensity t1 and a second area L4 with a magnetic field intensity lower than the specific magnetic field intensity t1, when a voltage and current of a specific frequency of F are supplied. It is desirable that the specific frequency F should have the frequency (e.g. 20 kHz) of the electric power supplied to the exciting coil to generate a magnetic field of the highest magnetic field intensity.

As described above, the specific magnetic field intensity t1 is a magnetic field intensity that has little effect on the nearby circuits. Equation 2 also holds for d2.

Therefore, the fixing protection cover 301 is provided at least 10 centimeters away from the surface of the exciting coil 11.

As a result, even when the circuits and optional units and the like are provided next the fixing protection cover 301 inside the protection covers 201*a*, 201*b*, 201*c*, the devices provided nearby can be prevented from malfunctioning.

Since the fixing apparatus where the distance from the surface of the exciting coil 11 to the fixing protection cover 301 is equal to d2 or more needs no fixed position set in the image forming apparatus in which the unit is to be installed, the labor involved in manufacture can be reduced. In addition, even when the fixing apparatus has been installed in an apparatus other than the image forming apparatus designed in manufacture owing to failure of the fixing apparatus or the like, the magnetic field intensity outside the fixing protection cover 301 of the fixing apparatus 1 can be secured at 6.25 μT or less.

THIRT EMBODIMENT

Figure 7:
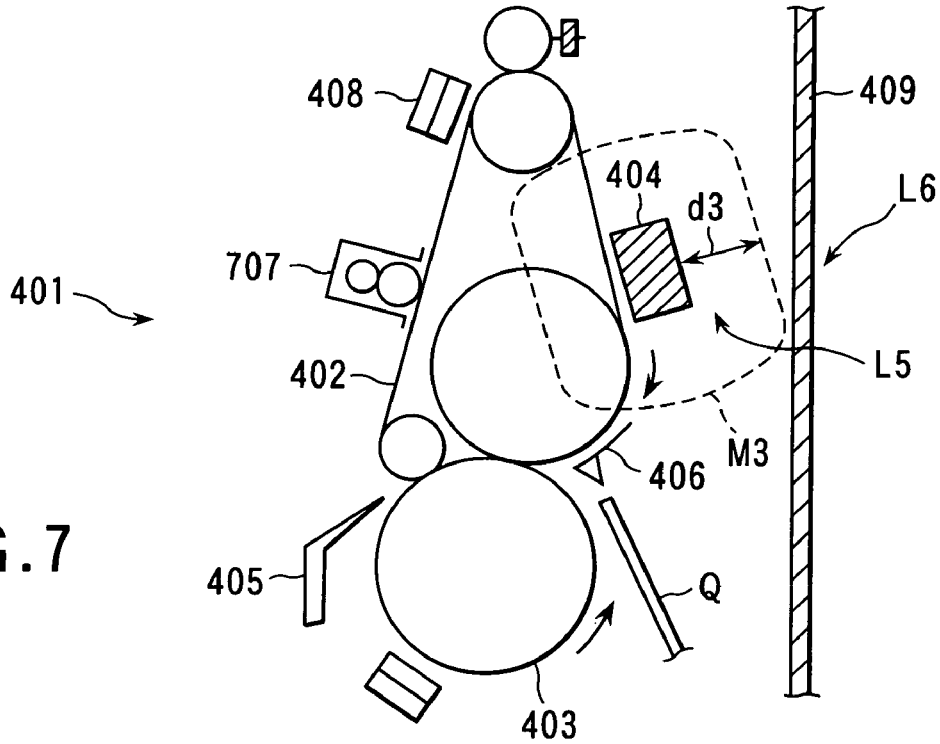
FIG. 7 is a schematic diagram to help explain another example of a fixing apparatus of the present invention.

FIG. 7 is a schematic diagram to help explain another example of an induction-heating fixing apparatus used in the image forming apparatus of FIG. 1.

The fixing apparatus 401 includes a conductive film 402, a pressure roller 403, an exciting coil 404, a peeling claw 405, a temperature sensing element 406, a cleaning member 407, and a heat generation abnormality sensing element 408. Although not shown, the fixing apparatus 401 is installed in an image forming apparatus having the same function as that of the image forming apparatus of FIG. 1. The fixing apparatus 401 is provided near an protection cover 409. The protection cover 409 is the outermost part of the image forming apparatus provided with the fixing apparatus 401.

The conductive film 402, which is an endless belt made of metal, such as nickel or stainless steel of several tens of micrometers in thickness, is moved in the direction shown by the arrow by a roller member provided at a specific position inside. The conductive film 402 may be a metal film obtained by depositing metal to a specific thickness on the surface of a highly heat-resistant resin film to form a sheet material and forming the sheet material into an endless belt shape.

The pressure roller 403 applies a specific pressure to the conductive film 402, thereby forming a nip with a specific width. Since the width of the nip can be determined arbitrarily by, for example, selecting the width in the direction of the movement of the conductive film 402, secured by the two roller members as shown in FIG. 7, a much greater nip width can be realized easily. In addition, the pressure roller 403 is rotated by a driving motor (not shown) in the direction shown by the arrow, that is, in the direction in which its surface is moved in the same direction at the contact position as that of the movement of the conductive film 402.

The exciting coil 404, which is provided at a specific position outside the conductive film 402, applies a specific magnetic field to the outer circumferential surface of the conductive film 402.

An eddy current flows in the conductive film 402 to which a magnetic field has been applied, with the result that Joule heat is generated. The sheet Q passes through the nip formed between the conductive film 402 and the pressure roller 403, thereby applying specific heat and pressure to the sheet on which the toner image is held, with the result that an image is formed on the sheet. The sheet Q passed through the nip is peeled by the peeling claw 405 provided on the downstream side of the pressure roller 403 and then is conveyed to the catch tray 113. The attached toner, paper powder or dust, and the like are removed by the cleaning member 407 provided on the downstream side of the nip at the outer circumferential surface of the conductive film 402. The temperature sensing element 406 and heat generation abnormality sensing element 408 are provided near the outer circumferential surface of the conductive film 402 and connected to the respective specific positions of the electric circuit shown in FIG. 4, which enables the conductive film 402 to be kept at a specific temperature.

The fixing apparatus 401 is provided near the protection cover 409 shown on the right. The protection cover 409 is connected to the outside on the right.

The fixing apparatus 401 is provided so as to leave at least a distance of d3 between the surface of the exciting coil 404 and the protection cover 409 so that the magnetic field intensity at the surface of the protection cover 409 may be equal to or lower than a specific value. Like d1, the distance d3 is defined as a point on a rough ellipse M3, the boundary line between a first area L5 with a magnetic field intensity equal to or higher than the specific magnetic field intensity t1 and a second area L6 with a magnetic field intensity lower than the specific magnetic field intensity t1, when a voltage and current of a specific frequency of F are supplied. It is desirable that the specific frequency F should have the frequency (e.g. 20 kHz) of the electric power supplied to the exciting coil to generate a magnetic field of the highest magnetic field intensity.

As previously described, the specific magnetic field intensity t1 is a magnetic field intensity that has little effect on the nearby circuits. Equation 2 also holds for d3.

Therefore, it is desirable that the protection cover 409 should be provided at least 10 centimeters away from the surface of the exciting coil 404.

Unlike the fixing apparatus 1 having the exciting coil 11 inside the heating roller 2, the exciting coil 404 is provide outside the conductive film 402. Therefore, since the magnetic field intensity is not decreased by the conductive film 402, d3 larger than d1 determined using equation 3 is required.

Therefore, the required d3 may be secured between the surface of the exciting coil 404 and the protection cover 409 by providing the exciting coil 404 in a position further away from the protection cover 409, that is, on the left side of the conducive film 402.

FOURTH EMBODIMENT

Figure 8:
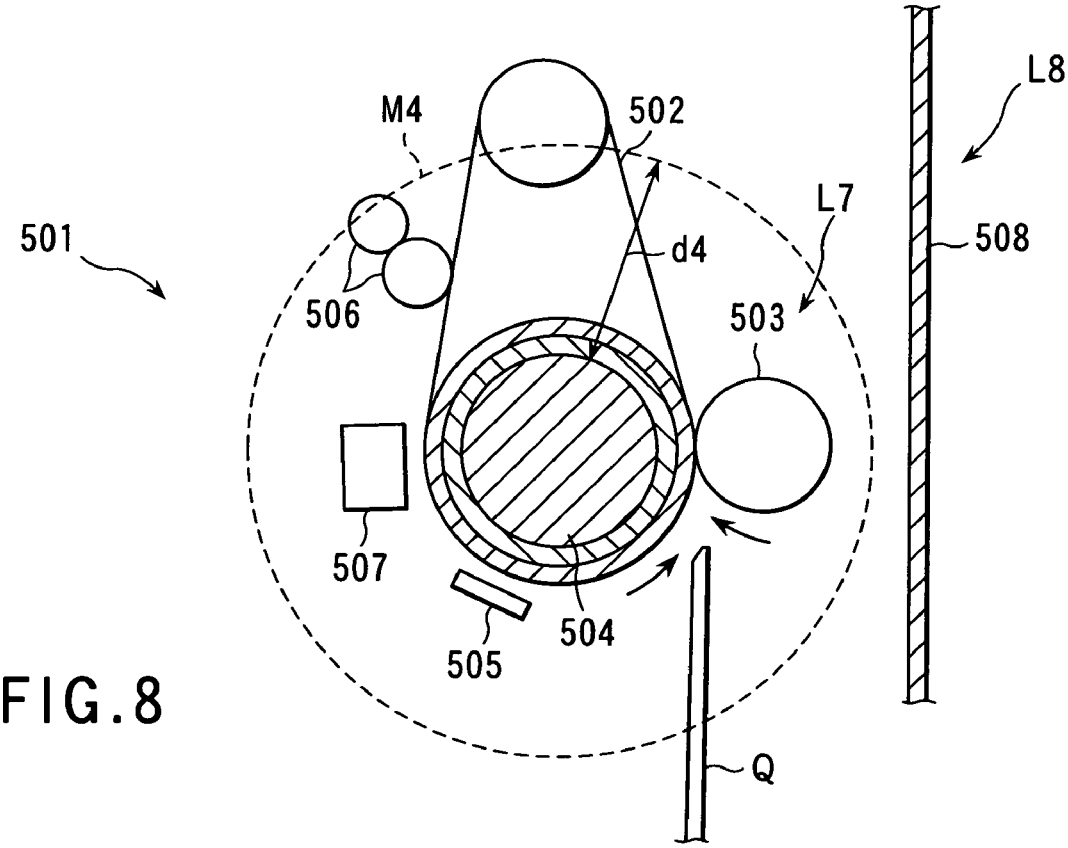
FIG. 8 is a schematic diagram to help explain a further example of a fixing apparatus of the present invention.

FIG. 8 is a schematic diagram to help explain a further another example of an induction-heating fixing apparatus used in the image forming apparatus of FIG. 1.

The fixing apparatus 501 includes a conductive film 502, a pressure roller 503, an exciting coil 504, a temperature sensing element 505, a cleaning member 506, and a heat generation abnormality sensing element 507. Although not shown, the fixing apparatus 501 is installed in an image forming apparatus having the same function as that of the image forming apparatus of FIG. 1. The fixing apparatus 501 is provided near an protection cover 508. The protection cover 508 is the outermost part of the image forming apparatus provided with the fixing apparatus 501.

Unlike the conductive film 502, which is an endless belt or a metal film comprising a metal layer, such as nickel or stainless steel of several tens of micrometers in thickness, is moved in the direction shown by the arrow by a roller member provided at a specific inside position.

The pressure roller 503 applies a specific pressure to the conductive film 502, thereby forming a nip with a specific width. The pressure roller 503 is rotated by a driving motor (not shown) in the direction shown by the arrow, that is, in the direction opposite to the direction in which the conductive film 502 rotates.

The exciting coil 504, which is provided at a specific position inside the conductive film 502, applies a specific magnetic field to the conductive film 502.

The fixing apparatus 501 is provided near the protection cover 508 shown on the right. The protection cover 409 is connected to the outside on the right.

The fixing apparatus 501 is provided so as to leave at least a distance of d4 between the surface of the exciting coil 504 and the protection cover 508 so that the magnetic field intensity at the surface of the protection cover 508 may be equal to or lower than a specific value. Like d1, the distance d4 is defined as a point on a rough circle M4, the boundary line between a first area L7 with a magnetic field intensity equal to or higher than the specific magnetic field intensity t1 and a second area L8 with a magnetic-field intensity lower than the specific magnetic field intensity t1, when a voltage and current of a specific frequency of F are supplied. It is desirable that the specific frequency F should have the frequency (e.g. 20 kHz) of the electric power supplied to the exciting coil to generate a magnetic field of the highest magnetic field intensity.

As previously described, the specific magnetic field intensity t1 is a magnetic field intensity that has little effect on the nearby circuits. Equation 2 also holds for d4.

As described above, in the present invention, the distance defined by equation 2 is secured between the exciting coil and the protection cover, thereby preventing a magnetic field of a specific magnetic field intensity or higher from leaking to the outside, which alleviates the effect on the circuits in the apparatus or optionally installed circuits (including a printer controller and a FAX controller). The invention may be applied to apparatuses other than those explained in the embodiments.

Preventing the high-frequency magnetic field generated from the coil from leaking to the outside of the fixing apparatus makes it possible to prevent the other devices in the apparatus from malfunctioning.

In addition, even when a magnetic field differing in intensity is generated according to the operation mode, the effect on the other devices in the apparatus can be reduced to a minimum.

What is claimed is:

1. A fixing apparatus comprising:

a coil which, when supplied with a voltage and current of a specific frequency, forms a first area having a magnetic field intensity equal to or higher than a specific intensity on the outside of the coil and a second area having a magnetic field intensity lower than the specific intensity on the outside of the coil, the coil being provided outside a conductive roller which generates heat by a magnetic field supplied from the coil; and a protection cover covering the periphery of the fixing apparatus which is provided near a boundary line between the first area and the second area so that its surface may have the specific magnetic field intensity or less, wherein if the distance between the coil and the protection cover is d and the distance between the protection cover and a specific position with a magnetic flux intensity of Td is D, the following expression holds:

$$d > \frac{\sqrt{A}\left(1+\sqrt{A}\right)}{(1-A)} \text{ where } A = \frac{Td}{6250} \quad D \geqq 20$$

2. The fixing apparatus according to claim 1, wherein the coil is supplied with a voltage and current of a frequency in the range of 20 to 100 kHz.

3. An image forming apparatus comprising:

a fixing apparatus including a coil which, when being supplied with a voltage and current of a specific frequency, forms a first area having a magnetic field intensity equal to or higher than a specific intensity on the outside of the coil and a second area having a magnetic field intensity lower than the specific intensity on the outside of the coil, the coil being provided outside a conductive roller which generates heat by a magnetic field supplied from the coil; and a protection cover housing the fixing apparatus which is provided in a position where the first area is formed inside so that its surface may have the specific magnetic field intensity or less, if the distance between the coil and the protection cover is d and the distance between the protection cover and a specific position with a magnetic flux intensity of Td is D, a range defined by the following expression is given:

$$d > \frac{\sqrt{A}\left(1+\sqrt{A}\right)}{(1-A)} \text{ where } A = \frac{Td}{6250} \quad D \geqq 20$$

4. The image forming apparatus according to claim 3, wherein the coil is supplied with a voltage and current of a frequency in the range of 20 to 100 kHz.

5. An image forming apparatus comprising:

a fixing apparatus including a coil which, when being supplied with a voltage and current of a specific frequency. generates a magnetic field with a specific magnetic field intensity, the coil being provided outside a conductive roller which generates heat by a magnetic field supplied from the coil; and a protection cover covering the periphery of the fixing apparatus which is at a specific distance away from the surface of the coil, wherein if the distance d between the surface of the coil and the protection cover is in a range defined by the following expression:

$$d < \frac{\sqrt{A}\left(1+\sqrt{A}\right)}{(1-A)} \text{ where } A = \frac{Td}{6250} \quad D \geqq 20$$

6. The image forming apparatus according to claim 5, wherein the coil is supplied with a voltage and current of a frequency in the range of 20 to 100 kHz.

* * * * *